US005133239A

United States Patent [19]

Thomas

[11] Patent Number: 5,133,239

[45] Date of Patent: Jul. 28, 1992

[54] CURVED FRET ARRANGEMENT FOR GUITAR OR SIMILAR INSTRUMENT

[76] Inventor: Rudolph Thomas, Rte. 1, Box 828, Patterson, Ga. 31557

[21] Appl. No.: 653,152

[22] Filed: Feb. 11, 1991

[51] Int. Cl.[5] ..... G10D 3/06

[52] U.S. Cl. ..... 84/314 R; 84/267

[58] Field of Search ..... 84/267, 314 R

[56] References Cited

U.S. PATENT DOCUMENTS

| | | | |
|---|---|---|---|
| 652,353 | 6/1900 | Edgren | 84/314 R |
| 3,103,846 | 9/1963 | Webster | 84/314 R |
| 3,392,618 | 7/1968 | Pelensky | 84/267 |
| 3,653,116 | 1/1972 | Pelensky | 84/314 R X |
| 4,308,784 | 1/1982 | Eizonas | 84/314 R |
| 4,846,038 | 7/1989 | Turner | 84/314 R |
| 4,852,450 | 8/1989 | Novak | 84/314 R |

FOREIGN PATENT DOCUMENTS 1-197792 8/1989 Japan .

*Primary Examiner*—W. B. Perkey
*Assistant Examiner*—Cassandra C. Spyrou
*Attorney, Agent, or Firm*—Schmeiser, Morelle & Watts

[57] ABSTRACT

A guitar or other similar musical string instrument having a fret-bearing fingerboard of conventional size and shape in which are placed oblique, almost parallel, arcuate frets. Frets are arranged on the fingerboard of this invention in an oblique-to-the-string relationship, appearing almost parallel and slightly arced so as to maintain a correspondence between the fret-string intersections of the invention and the fret-string intersections of the similar conventional instrument. Arcing the frets, and departing from precise parallelism, assures maintenance of the diatonic scale and the corresponding fret-string intersection relationship between the invention and a similar, but conventional, instrument. Such a familiarity and correspondence allows seasoned musicians to convert over to the invention instrument(s) with little or no difficulty.

5 Claims, 2 Drawing Sheets

CURVED FRET ARRANGEMENT FOR GUITAR OR SIMILAR INSTRUMENT

BACKGROUND OF THE INVENTION

1. Field of the Invention

This invention relates generally to string musical instruments which employ frets for the purpose of providing a multiplicity of fixing points corresponding to a musical scale. More specifically, there is disclosed an improved fret architecture which facilitates a musician's ability to color each note by means of techniques which are easily practiced with this invention.

2. Discussion of Relevant Art

There have been several innovations over the years that deal with elements of musical instruments, especially those which are string instruments and employ frets as a means for maintaining a fixed musical scale. The length of an "open" or unfretted string and the spacing of the frets is carefully calibrated, so that when a finger, or other device presses a string to a specific fret, and the string is plucked, the string will vibrate at a specified precise frequency. This frequency is determined by the distance between the aforementioned fret and the bridge, a point of permanent fixture of the string. A musical scale consists of a series of specific frequencies, called notes; and, various notes are played by pressing the string down to various frets and plucking or strumming the strings. A slight vibrato, that is, a transition between a higher pitch and lower pitch on any particular note (done very rapidly) is obtained by rocking the playing finger slightly and longitudinally along the vibrating string. In a modern musical group, where there is perhaps more than one guitar player, certain instrument players strive for a vibrato in order to lend a certain "coloration" to notes, which might be an enhancing characteristic of the ensemble. Even though the vibrato, or variance of pitch from flat to sharp, is a highly sought-after playing characteristic, little has been done, as a discussion of the relevant art will hereinafter show, to acquire the vibrato differently and easier by a change to the physical appearances of the guitar or similar fretted instrument respecting the fret/string/bridge arrangement.

Before discussing the relevant art, which I located during a search of patent records, it is well to define a few words which I will use throughout this disclosure. I will refer to the body of a guitar, banjo or mandolin as the "box" and the portion spaced-apart from the box, and on which the various strings are tightened or wound, as the head. Thus, between the box and the head is the neck, upon the top surface of which is the fingerboard. Spaced along and transverse the fingerboard/neck are the multiplicity of ridge fixing points or frets. The bridge is located in the lower portion of the box and the strings are stretched from the bottom of the box over the bridge and to the tuning keys located in the head. There is a nut, similar to a small bridge, between the fingerboard and the head and over which the strings pass before engagement with the tuning key's capstans. Thus, the length of the strings is essentially the same, running from the nut to the bridge. The straight frets, transverse the neck (in conventional arrangement), underlie the strings and form generally right angles with them. When not in play, all of the strings are disposed above the neck in a stand-apart relationship with all of the frets. In the conventional guitar, or fretted instrument, the strings may be tuned through three octaves, the frets being parallel and spaced variably in correspondence with the musical scale for which the instrument is devised. Thus, when I speak of moving longitudinally "down string", I mean in the direction of the box, from the first or lower octave towards the second or higher octave. The instant invention does not attempt to depart radically from the methods used to play the guitar in that, during the "fingering" of the various notes, the player would still place his fingers in the conventional position for acquiring a certain "natural" note or chord, and there would contact a fret at the conventional fret-string location. The art discovered during my patent search is not seen to depart from most of the conventional incidents of the various instruments. In Japanese patent 1-197792, the traditional neck length of an instrument is retained, along with the space arrangement of the various frets. However, in the second octave, the frets are diminished in length by at least 50%. This has the effect of rendering approximately one-half the strings without companion frets in the second octave. In U.S. Pat. No. 3,392,618, a multirange fretted guitar-type instrument is disclosed in which the base of the neck is slanted as it is attached to the box, but a bridge is retained in the conventional position. The neck is expanded in two steps so that four strings are provided from the head to the box along the neck portion, four strings are provided from the nut portion of the first step, running to the bridge; and four strings are additionally provided at the second step nut to the bridge. Thus, the patentee of '618 has provided a string/fretted instrument of remarkable range, for example from contralto (such as banjo) to bass (such as bass guitar). Still, the frets remain in the conventional or traditional positions so that what is taught is unusual regarding the span of the frets but not in their physical relationship to the strings.

What is most noticeable in the conventional art is that when the string is pressed to a fret and plucked or strummed, a particular note emanates from a properly tuned string that is dependent upon the tension of the string and its length, as determined by the distance between the fret and bridge. Moving the string back and forth across the fret would generally increase the pitch because of the increase of string tension. To effect a similar pitch change, the finger evoking the desired note would have to be moved slightly up or down string, that is, towards the head or towards the box, respectively. Movement of the fingertip towards the head would lengthen the fret to bridge distance, thus lowering the pitch. Moving the fingertip toward the box would shorten the fret to bridge distance, thus raising the pitch. In normal play, the fingers are pressed just behind the frets and the movement or rolling of the finger up or down string requires a high degree of dexterity and some (to varying degree) rotation/derotation of the wrist. I sought to, and succeeded in, devising a new fret arrangement that would allow the player to acquire a great deal of vibrato, yet not be required to move the finger up or down the string. It was my objective to obtain a better vibrato with a more natural push-pull of the finger on the string such as may be done in a conventional guitar but would only evoke a rise in pitch.

SUMMARY OF THE INVENTION

I have designed a fret arrangement on the neck of a conventional fretted string instrument that dispenses with the need for conventional fingertip motion or wrist rotation for acquiring significant vibrato. My goal, to enable the guitarist (for example) to raise or to lower the pitch of the note by a more natural extension or retraction of the finger is realized by slanting the frets in relationship to the neck so that, as a string is pushed or pulled on the fret, the slanted nature of the fret will effect a shortening or lengthening of the string being played The frets of this new design are obliquely arranged relative to the string direction, almost parallel with each other and have a slight arcuate path. Looking to the top side of a guitar, in which the box may be said to reside in a southernly and the head in a northernly direction, the fret pattern is oblique to the strings and slightly arcuate from the north east, generally to the southwest direction or, from the upper right to the lower left. I arrived at the arcuate shape of the oblique or slanted frets somewhat empirically; however, a pattern of frets may be readily devised by simply mapping the fret-string contact points of a conventional guitar onto a guitar fingerboard of the present invention, that has corresponding parameters. Thus, with the final result, a guitar or similar fretted instrument of the instant invention is played in every sense like a conventional instrument save that the strings are pushed or pulled across the arcuate, slanted fret in order to acquire the sharp or flat phases of a particular note.

DETAILED DESCRIPTION OF THE PREFERRED EMBODIMENT

As mentioned earlier, my main goal in developing this invention was to enable a player to lower and raise the pitch of a note by merely pulling the string and pushing it, rather than rolling or moving the fingertip along the string or being satisfied with less than a full vibrato. As will readily be seen, with reference to the drawings, pulling the string to the right lengthens the contact point of the string, that is, the fret-to-bridge distance, thus lowering or "flatting" the note. Pushing the string to the left shortens the contact point thereby raising the pitch of (or "sharping") the note.

Figure 1:
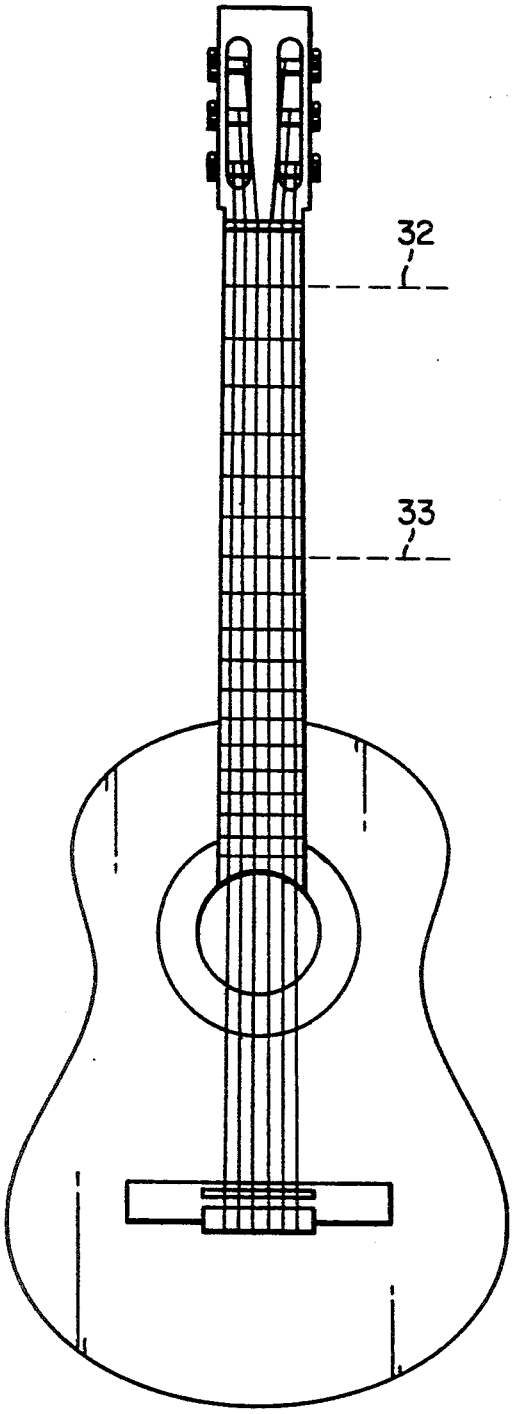
FIG. 1 PRIOR ART
FIG. 1 is an illustration of the face of a conventional string-fretted instrument as known in the art.
Figure 2:
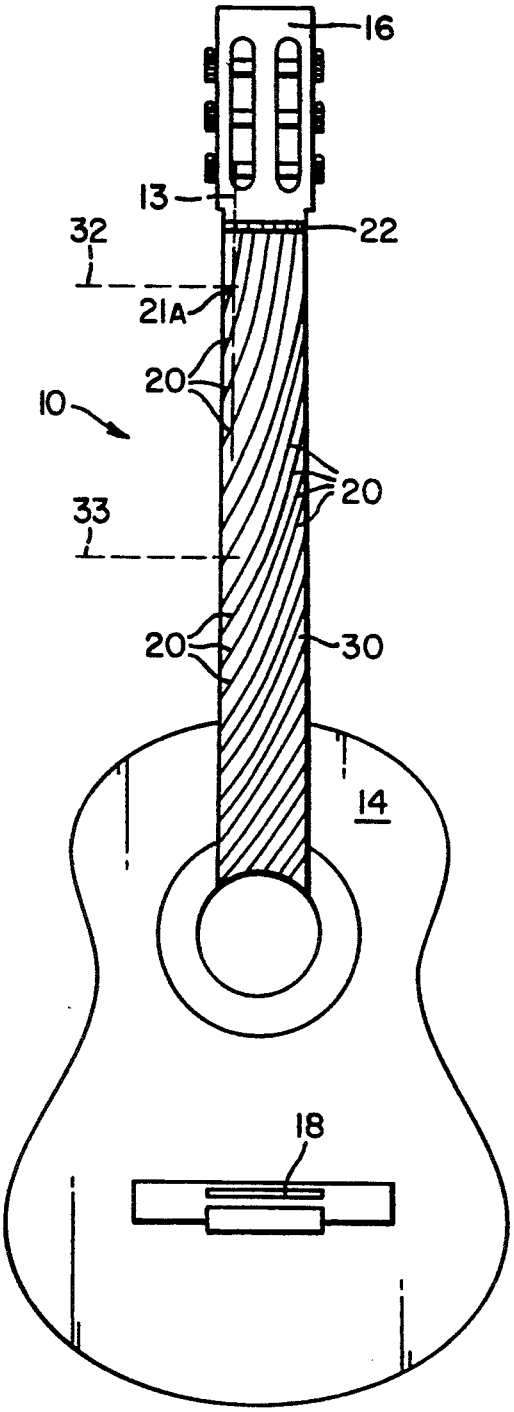
FIG. 2 is the illustration of the face of a guitar bearing my invention in the fret application pattern.

Referring more particularly now to FIGS. 1 and 2 there is shown in a juxtaposed position the prior art, or more conventional guitar (FIG. 1), and my invention 10 (FIG. 2). FIG. 2 is shown without strings 12 which will be apparent in the other figures. The guitar of FIG. 2 is conventional in almost all respects, comprising a body 14 bearing a bridge 18, a neck 30, also called the fingerboard or fret board, nut 22 and head 16. Appearing, most unorthodox, is the fret pattern 20 residing on the fingerboard 30. The reader should note how the fret pattern begins, namely, the first fret beginning at the board 30 head 16 interface, moving (slightly) arcuately down-string and over to the left of the board 30, terminating at the edge of the board on the left hand side just down-string of the intersection of fret 21A and (phantom) string 13. Reference to dashed line 32, running from FIG. 1 to the aforementioned string-fret intersection, clearly illustrates that the string-fret intersection is found in its conventional position. Such is no mere accident; and the remaining frets are placed on the fingerboard 30 in much the same fashion, emanating from around either the nut 22 or the right hand side of the board 30 in an essentially parallel path and slightly arcuate manner to terminate at the left side of the fingerboard. In any string instrument the note is a function of the length of a string. Thus, as the string is shortened, the distance between frets of a fretted instrument is decreased in order to maintain diatonic scale. Reference to dashed line 33, running between FIGS. 1 and 2, will illustrate, for example, how the down-string relationship between frets and strings is maintained only if the fret is given the slight curvature shown therein. It is for this reason that I term my fret arrangement oblique (in relationship to the strings), almost parallel (not precisely parallel) and arcuate (having a curvature). Relative to the head, the curvature of the frets is concave.

Figure 3:
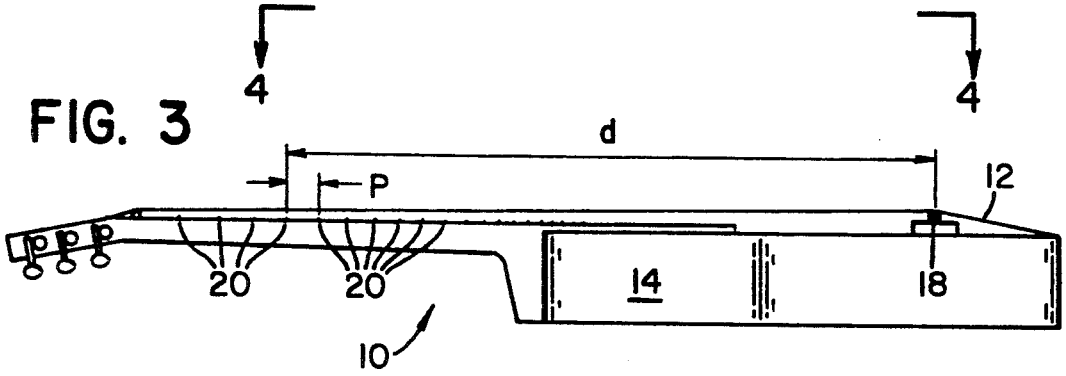
FIG. 3 is a side elevation of a guitar or similar instrument bearing the invention.
Figure 4:
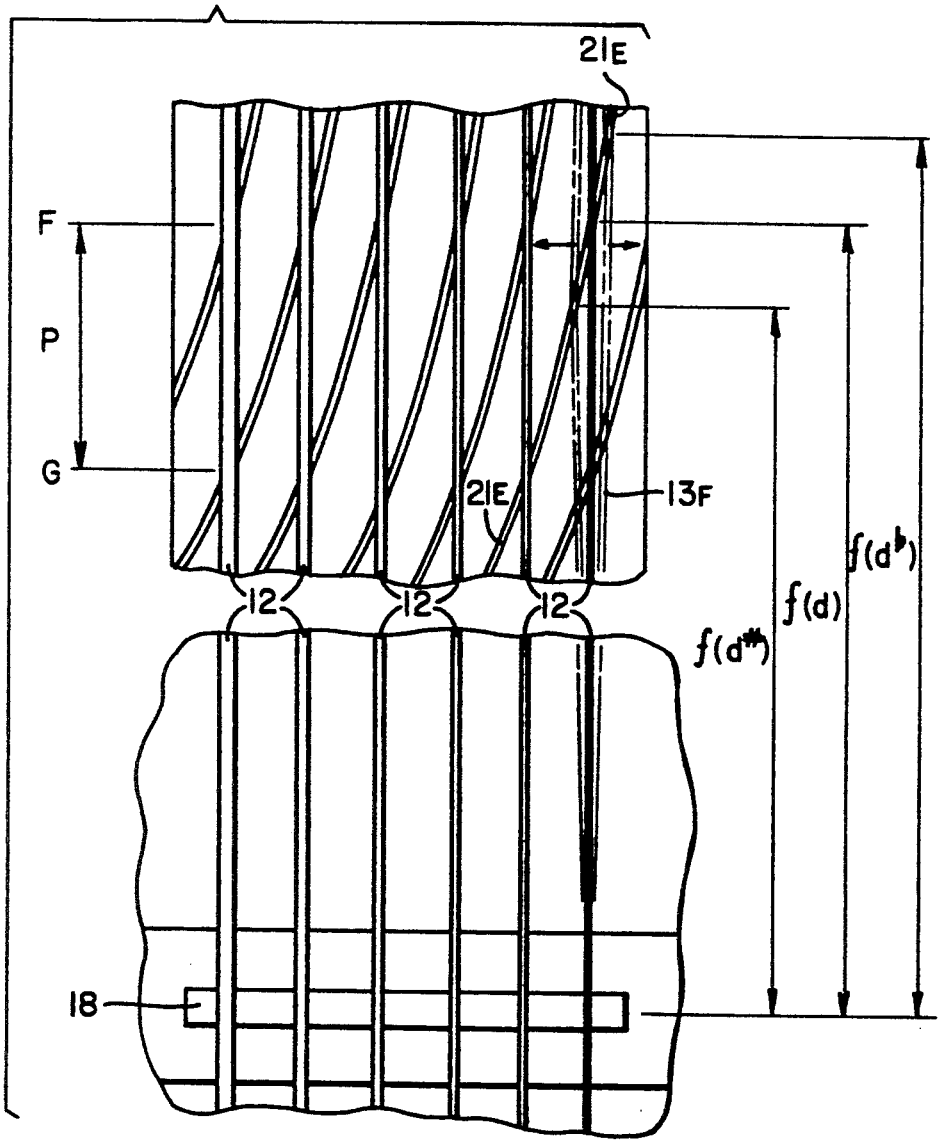
FIG. 4 is a compressed view of the FIG. 3 illustration taken at 4—4.

In FIG. 3, the invention 10 is illustrated in side elevation. In addition to the fret layout 20, two general and variable parameters are pointed out, p representing the distance between frets and d representing the distance (or length of a string 12) from a fret 20 to the bridge 18. These distances are related more clearly in FIG. 4 which is a compressed, top view of the fingerboard and box areas between any arbitrary fret and the bridge 18. In FIG. 4, p may be seen as the spacing between two frets 20 (not depicted). At the right hand side of FIG. 4, the fret-bridge distance d is also depicted. To illustrate, let us say that the playing finger presses string 13F to fret 21E. When the string is plucked or strummed, a particular note, f(d), will emanate based on such parameters as the gu age of the string and its tension and, quite importantly, the distance d between the fret and the bridge 18 which determines thereby the length of the string. If the string is now pushed to the left, the distance d will be shortened resulting in a sharping of the note, $f(d)^{\#}$ and conversely, if the string is pulled, the effect will be a lengthening of the string resulting in a flatting of the note, $f(d)^{\flat}$.

In order to more fully disclose this invention, I will relate my own experience with this instrument. In order to play a high E, twelfth fret, first string on a conventional guitar, I would first have to finger the eleventh fret, first string E flat, and then stretch the string until it sounds E natural, subsequently moving my finger to the right and to the left, lowering and raising the pitch of the note. With my new slanted fret guitar, I go directly to the E natural note (it appears in its normal location relative to the string and fingerboard). I move my finger to the right to lower the note and move it to the left quickly to raise the pitch of the note. This makes it much faster and much simpler to acquire the desired vibrato. I also acquire enhanced alterability of a chord by simply moving one or more fingers to the right or to the left, as described above.

Seasoned guitar players will recognize, in this invention, an ability to more readily develop the desired mutation of notes and chords with but very little practice with the invention. Many different and unusual effects may be realized by the accomplished player and thus, guitars and similar fretted string instruments, bearing my present invention are commended to them for use and practice consistent with the hereinafter appended claims.

What is claimed is:

1. In a guitar or similar fretted, musical stringed instrument characterized by a body, a straight elongate neck extending from the body to a head and at least one string stretched from proximate the head to a position on the body and overlying a set of frets disposed on the neck, the improvement comprising a fret layout in which elongate, curved frets are oriented and begin on a fingerboard from a direction generally oriented towards a head bridge and terminate on the finger board and generally in a direction toward a body bridge, a majority of said frets disposed under and which traverse all strings of the instrument and each of said frets essentially non-parallel to the others in said layout while forming therewith a family of fret curves lying in a common plane.

2. The instrument of claim 1 wherein the strings and frets intersect proximate corresponding string-fret intersections of another similar conventional instrument.

3. A fretted musical string instrument having in combination a straight elongate neck, having a fret board disposed thereon, connecting a head means to a body means, the fret board having a plurality of frets that are fixedly disposed on the fret board, said plurality of frets characterized by initial positions generally oriented towards the head means, and running thence in similar, non-parallel curved paths to final positions on the fret board and generally oriented towards the body means, said frets comprising over said neck and fret board a planar family of curves a majority of which lie in a common plane and underlie all strings of the instrument.

4. The instrument of claim 3 wherein said frets underlie essentially parallel strings, each of said frets thereby effecting with each of said strings that each of said frets underlies, a different acute angle intersection than effected by an adjacent string or fret.

5. A musical string, bridged instrument comprising a combination of oblique, arcuate, and elongate frets disposed on and beginning on a finger board from a head bridge orientation and terminating on the finger board towards a body bridge orientation, a majority of said frets disposed under and traversing all strings of the instrument and further comprising a family of fret curves, each of said fret curves lying in the same or common plane.

* * * * *